US005711556A

United States Patent [19]

Masters

[11] Patent Number: 5,711,556

[45] Date of Patent: Jan. 27, 1998

[54] LOCK ASSEMBLY

[75] Inventor: Allan R. Masters, Balgowlah, Australia

[73] Assignee: RMD Press Co., Pty., Ltd., Sunshine, Australia

[21] Appl. No.: 601,501

[22] Filed: Feb. 14, 1996

[30] Foreign Application Priority Data

Feb. 14, 1995 [AU] Australia ..... PN1126/95

[51] Int. Cl.[6] ..... E05C 19/16

[52] U.S. Cl. ..... 292/251.5; 292/201; 292/210

[58] Field of Search ..... 292/251.5, 209, 292/210, DIG. 22, DIG. 38, 203, 201

[56] References Cited

U.S. PATENT DOCUMENTS

| | | | |
|---|---|---|---|
| 3,129,968 | 4/1964 | Graham | 292/201 |
| 3,592,495 | 7/1971 | Fisher | 292/76 |
| 3,860,277 | 1/1975 | Wang | 292/201 X |
| 4,702,506 | 10/1987 | Iimura | 292/251.5 |
| 5,035,451 | 7/1991 | Brady | 292/210 X |
| 5,188,405 | 2/1993 | MacCaferri | 292/251.5 X |
| 5,405,037 | 4/1995 | Piron | 292/251.5 X |
| 5,518,282 | 5/1996 | Sawada | 292/251.5 X |

*Primary Examiner*—Rodney M. Lindsey
*Attorney, Agent, or Firm*—Sughrue,Mion,Zinn,Macpeak & Seas, PLLC

[57] ABSTRACT

A lock assembly (1) including first and second components (2,3) adapted to be releasably engaged, the first component including an element (8) having a latch portion (7) for interlocking with a keeper means (22), the latch portion being held in an unlocked position in its rest state and being movable to engage with the keeper means as a result of magnetic attraction therebetween.

23 Claims, 3 Drawing Sheets

LOCK ASSEMBLY

BACKGROUND OF THE INVENTION

This invention relates to a lock assembly, particularly but not exclusively to a lock assembly for use in releasably engaging a pool gate to a post.

A known form of latch mechanism for locking a gate to a post comprises a latch mounted on the post and weighted toward a closure position, and a catch, in the form of a striker plate mounted on the gate, which co-operates with the latch. It is also known to provide spring bias on the latch for urging the latch into the closure position and/or a magnet located on the catch which serves only in assisting to releasably retain the latch once the latch has engaged with the catch.

Provision of a spring, in the case where the spring alone serves the purpose of urging the latch toward the closure position, has the disadvantage that failure or fatigue of the spring may result in the latch mechanism becoming inoperative. The likelihood of such failure may be considerably increased in the case where the latch mechanism is used in a moist or exposed environment, such as may be found next to a swimming pool.

Also, provision of a latch which is always weighted or urged toward the closure position can lead to wear of the latch and catch, and potentially undesirable noisy closure of the gate, as a result of the latch striking the striker plate for locking engagement therewith.

SUMMARY OF THE INVENTION

It is an object of the present invention to address the abovementioned disadvantages.

In accordance with the present invention there is provided a lock assembly comprising first and second components adapted to be releasably engaged, the first component including an element having a latch portion movable between an unlocked and a locked position and the second component including keeper means for interlocking with the latch portion to thereby lock the components together, wherein the element is adapted for magnetic attraction to the keeper means whereby location of the latch portion adjacent the keeper means results in the latch portion moving into locking engagement with the keeper means, the arrangement of the element being such that, in the absence of the magnetic attraction, the latch portion is held in the unlocked position by gravity.

Preferably, the element includes a lever portion, and is pivotally mounted to a main body of the second component intermediate the latch and lever portions, wherein the lever portion is operable to pivot the element and displace the latch portion from the locked position to the unlocked portion, against the magnetic attraction of the keeper means, for release of the components.

Preferably, the keeper means includes a projecting boss for engagement with the latch portion. Preferably, the keeper means further includes a magnet arranged adjacent the boss for magnetically attracting the latch portion.

Preferably, the latch portion is formed of metal.

Preferably, the arrangement of the element is such that the latch portion, in the absence of sufficient magnetic attraction to hold it in the locked position, returns to the unlocked position by gravity.

Preferably, the body of the first component includes a recess for receiving the boss, the latch portion being arranged to engage the boss within the recess.

Preferably, the element is mounted to extend through a wall of the body defining the recess such that the lever portion is operable exteriorly of the recess.

In accordance with another aspect of the present invention, there is provided a gate post and a gate assembly including the abovedescribed lock assembly, wherein the first component is secured in the post and the second component is secured to the gate to effect locking engagement between the post and the gate, the post having a control member extending interiorly thereof, from an upper region of the post to the lever portion of the first component of the lock assembly, the control member being displaceable lengthwise of the post whereby to effect movement of the lever portion and thereby the latch portion, from the locked to the unlocked position.

Preferably, the post includes a security element, such as a key actuated lock, for selectively securing the control member from unauthorised operation.

BRIEF DESCRIPTION OF THE DRAWING

The invention is further described, by way of non-limiting example only, with reference to the accompanying drawings, in which.

DETAILED DESCRIPTION OF THE INVENTION

Figure 1:
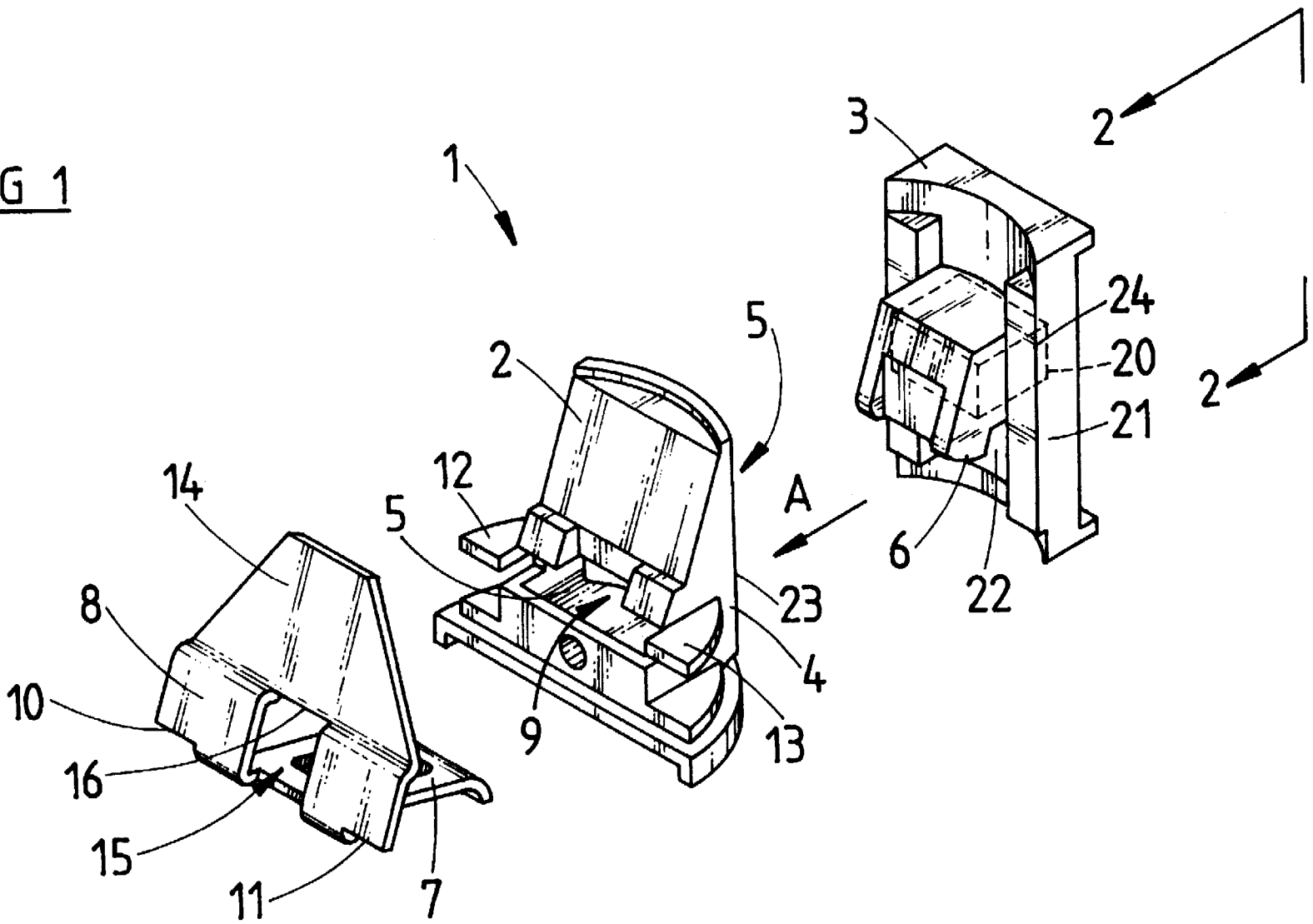
FIG. 1 is perspective view of first and second components of a lock assembly in accordance with the invention.

Lock assembly 1 comprises a first component 2 and a second component 3. The first component is formed of a main body 4 which defines a recess 5. A latch portion 7 of a metal element 8 extends through a slot 9 in the body 4 to project into the recess 5 for releasable locking engagement with keeper means 22 of the second component 3.

The element 8 has laterally extending flanges 10, 11 which are supported on pivot mounts 12, 13 disposed to either side of slot 9. The element 8 also includes lever portion 14 having an opening 15 defining an actuating surface 16 which is, in use, engaged by a control member (not shown) for manual pivoting of the member about the mounts 12, 13.

Figure 2:
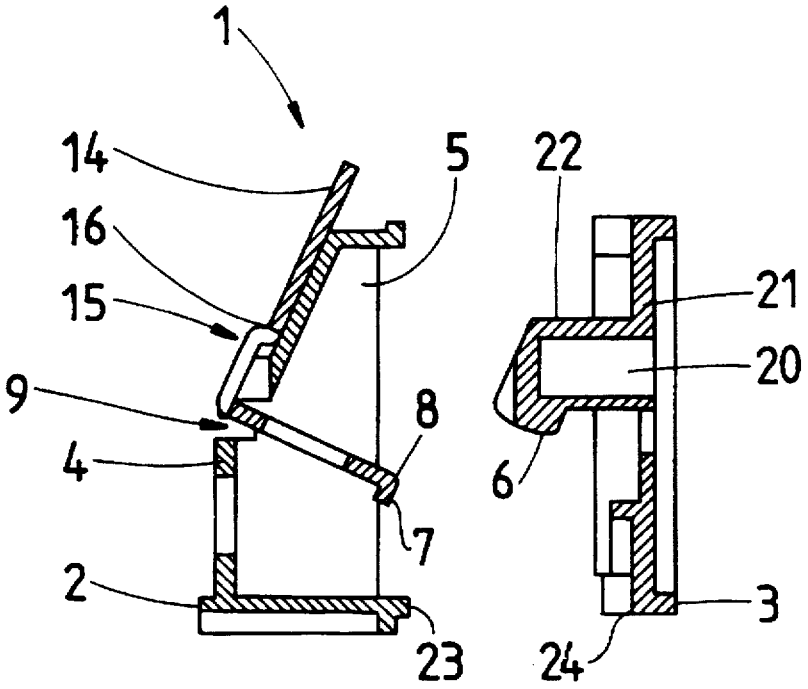
FIG. 2 is a cross-sectional view on a line 2—2, shown in FIG. 1.
Figure 3:
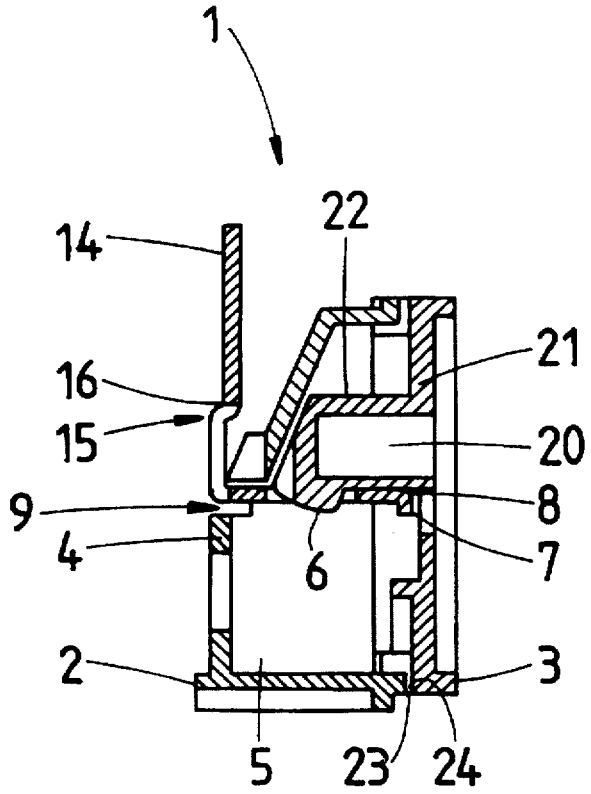
FIG. 3 is a cross-sectional view on the line 2—2, showing the components in a locked condition.

The keeper means 22 includes a boss 6 and a magnet 20 arranged in a body portion 21 of the component 3, adjacent the boss 6. Component 3 is locked to the first component 2 by advancing the component 3 toward component 2 in a direction indicated by arrow 'A', so that the boss 6 passes over the latch portion 7 of element 8 and the magnet 20 magnetically attracts the latch portion such that the element 8 pivots from the unlocked position shown in FIG. 2 to a locked position whereby the latch portion 7 captures the boss 6, as shown in FIG. 3. Peripheral edges 23, 24 of each component 2, 3 are adjacent when the components are locked together so as to restrict access to the recess 5. The lever portion 14 can be manually engaged by the control member to return the latch portion to a position shown in FIG. 2, for release of the two components.

Figure 4:
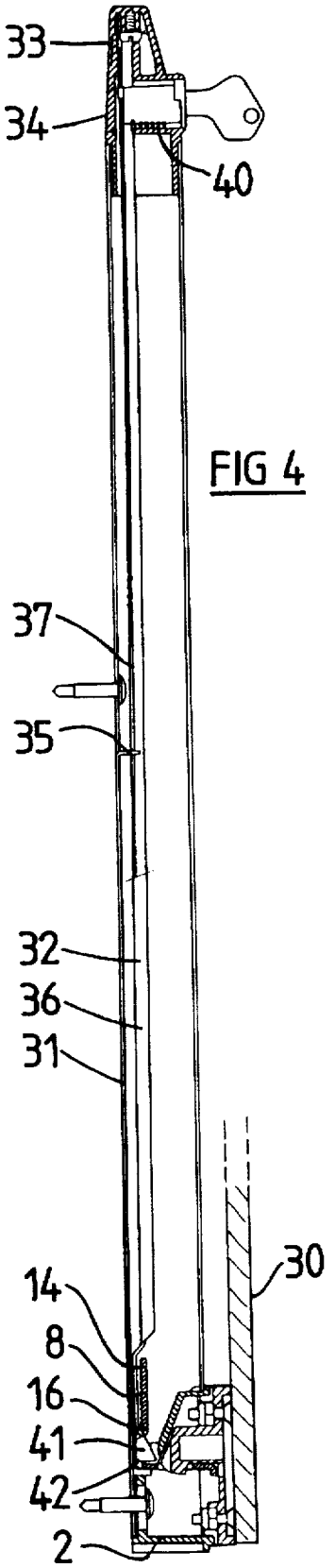
FIG. 4 is a cross-sectional view of a gate and a gate post incorporating the assembly of FIGS. 1 to 3.

The assembly 1 can be used for locking a gate 30 to a gate post 31, as shown in FIG. 4. The gate post includes a control member 32 in the form of elongate bar 36 which extends interiorly of the post from a lifting handle 33, at an upper portion 34 of the post, to the lever portion 14 of the first component 2 of the assembly. The post also includes a bar stop 35 which extends through an opening 37 in the bar 36 to control the extent to which the bar 36 may be lifted by the handle 33. A key actuated lock 40 is also provided at the upper portion 34 of the post 31 to prevent unauthorised lifting of the handle 33.

Figure 5:
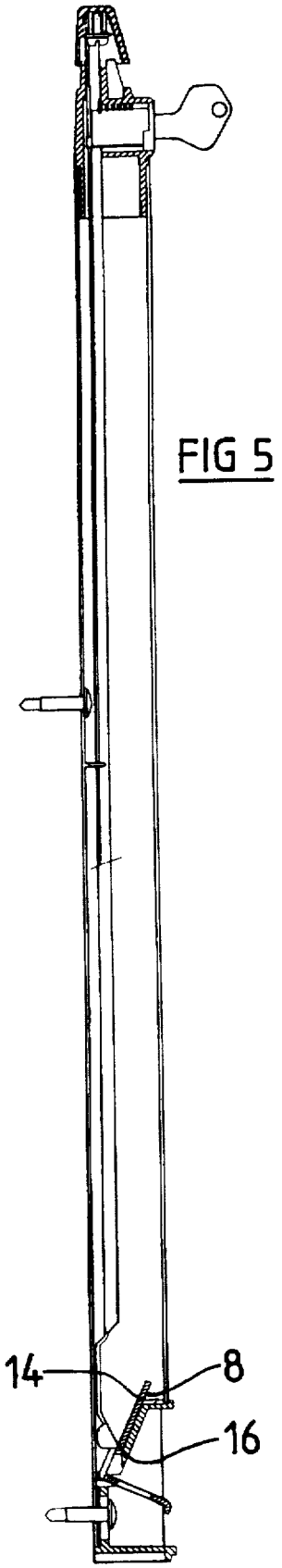
FIG. 5 is a cross-sectional view of the post of FIG. 3 showing the lock assembly in a disengaged condition.

To unlock the gate from the post, the key actuated lock 40 is released to permit lifting of the bar 36 via handle 33. Upon lifting, a ramp portion 41 at the end 42 of the bar 36 engages the actuating surface 16 of the element 8 and the actuating surface is forced along the ramp portion 41 as the bar 36 is drawn upwardly to thereby cause the element 8 to pivot clockwise, from the locked position shown in FIG. 4 to the unlocked position shown in FIG. 5. Such movement is effective in disengaging the latch portion 7 from the boss 6 of the second component 3 of the assembly 1, so that the gate 30 can be disengaged from the post 31.

As can be appreciated from the above, the lock assembly utilises magnetic attraction between magnet 20 and latch portion 7, to lift the latch portion upwardly into the locked position and relies on gravity to maintain the latch portion in the unlocked position in the absence of such magnetic attraction. As such, no spring bias is required to hold the latch portion in an unlocked condition. The above described lock assembly therefore has particular application to locking a pool enclosure gate where conventional locking assemblies which use spring biased latches may be subject to damage and possible failure caused by corrosion of the springs. The arrangement of the lock assembly in a pool gate and post also restricts tampering by children since locking engagement between the latch portion 7 and the boss 6 occurs within the recess 5 of the first component and access to the recess is not readily available when the components are locked together. Additionally, the lock assembly of the present invention has a simple construction and utilises only one movable part.

The described lock assembly has been advanced merely by way of explanation and many modifications and variations may be made thereto without departing from the spirit and scope of the invention which includes every novel feature and combination of novel features herein disclosed.

What is claimed is:

1. A lock assembly comprising first and second components adapted to be releasably engaged, the first component including a body defining a cavity open at an open side thereof and an element having a latch portion within the cavity and movable between an unlocked and a locked position, and the second component including keeper means with a downwardly depending boss for interlocking with the latch portion under relative movement between the first and second components, the boss of the keeper means arranged for being entered in a generally horizontal direction into the cavity from said open side to a position above the latch portion, to thereby lock the components together, wherein the element is adapted for magnetic attraction to the keeper means, magnetic means being provided in the keeper means for producing said magnetic attraction such that location of the latch portion adjacent the keeper means results in the latch portion moving upwardly into locking engagement with said boss of the keeper means, the arrangement of the element being such that, in the absence of the magnetic attraction, the latch portion is held in the unlocked position by gravity.

2. A lock assembly as claimed in claim 1, wherein the element includes a lever portion, and the lever portion is pivotally mounted to the body of the first component intermediate the latch and lever portions, wherein the lever portion is operable to pivot the element and displace the latch portion from the locked position to the unlocked position, against the magnetic attraction of the keeper means, for release of the components.

3. A lock assembly as claimed in claim 2, wherein the element is mounted to extend through a slot in a wall of the body defining the recess such that the lever portion is operable exteriorly of the recess.

4. A lock assembly as claimed in claim 3, wherein the keeper means includes a magnet arranged adjacent the boss, said magnet comprising said magnetic means.

5. A lock assembly as claimed in claim 4, wherein the arrangement of the element is such that the latch portion, in the absence of sufficient magnetic attraction to hold it in the locked position, returns to the unlocked position by gravity.

6. A lock assembly as claimed in claim 1, wherein the latch portion is formed of metal.

7. A lock assembly as claimed in claim 1, wherein the arrangement of the element is such that the latch portion, in the absence of sufficient magnetic attraction to hold it in the locked position, returns to the unlocked position by gravity.

8. A lock assembly as claimed in claim 2, wherein the arrangement of the element is such that the latch portion, in the absence of sufficient magnetic attraction to hold it in the locked position, returns to the unlocked position by gravity.

9. A lock assembly as claimed in claim 3, wherein the arrangement of the element is such that the latch portion, in the absence of sufficient magnetic attraction to hold it in the locked position, returns to the unlocked position by gravity.

10. A gate and gatepost assembly, including a lock assembly, the lock assembly comprising:

first and second components adapted to be releasably engaged, the first component including an element having a latch portion movable between an unlocked and a locked position and the second component including keeper means for interlocking with the latch portion to thereby lock the components together, wherein the element is adapted for magnetic attraction to the keeper means, and one of said latch portion and second component being provided with magnetic means for producing said magnetic attraction whereby location of the latch portion adjacent the keeper means results in the latch portion moving into locking engagement with the keeper means, the arrangement of the element being such that, in the absence of the magnetic attraction, the latch portion is held in the unlocked position by gravity, the element including a lever portion, and being pivotally mounted to a main body of the first component intermediate the latch and lever portions, wherein the lever portion is operable to pivot the element and displace the latch portion from the locked position to the unlocked portion, against the magnetic attraction of the keeper means, for release of the components, the first component being secured in the gatepost and the second component being secured to the gate to effect locking engagement between the gatepost and the gate, the gatepost having a control member extending interiorly thereof, from an upper region of the gatepost to the lever portion of the first component of the lock assembly, the control member being displaceable lengthwise of the gatepost whereby to effect movement of the lever portion and thereby the latch portion, from the locked to the unlocked position.

11. A gate and gatepost assembly as claimed in claim 10, wherein the gatepost includes a security element for selectively securing the control member from unauthorized operation.

12. A gate and gatepost assembly as claimed in claim 11, wherein the arrangement of the element is such that the latch portion, in the absence of sufficient magnetic attraction to hold it in the locked position, returns to the unlocked position by gravity.

13. A gate and gatepost assembly as claimed in claim 10, wherein the element is mounted to extend through a slot in a wall of the body defining a cavity such that the lever portion is operable exteriorly of the cavity.

14. A gate and gatepost assembly as claimed in claim 13, wherein the arrangement of the element is such that the latch portion, in the absence of sufficient magnetic attraction to hold it in the locked position, returns to the unlocked position by gravity.

15. A gate and gatepost assembly as claimed in claim 10, wherein the arrangement of the element is such that the latch portion, in the absence of sufficient magnetic attraction to hold it in the locked position, returns to the unlocked position by gravity.

16. A gate and gatepost assembly, including a lock assembly, the lock assembly comprising first and second components adapted to be releasably engaged, the first component including a body defining a cavity open at an open side thereof and an element having a latch portion within the cavity and movable between an unlocked and a locked position, and the second component including keeper means with a downwardly depending boss for interlocking with the latch portion under relative movement between the first and second components such that the boss of the keeper means is entered in a generally horizontal direction into the cavity from said open side, to thereby lock the components together, wherein the element is adapted for magnetic attraction to the keeper means, magnetic means being provided between said first and second components for producing said magnetic attraction such that location of the latch portion adjacent the keeper means results in the latch portion moving upwardly into locking engagement with said boss of the keeper means, the arrangement of the element being such that, in the absence of the magnetic attraction, the latch portion is held in the unlocked position by gravity, the element including a lever portion, and being pivotally mounted to the body of the first component intermediate the latch and lever portions, wherein the lever portion is operable to pivot the element and displace the latch portion from the locked position to the unlocked portion, against the magnetic attraction of the keeper means, for release of the components, the first component being secured in the gatepost and second component being secured to the gate to effect locking engagement between the gatepost and the gate, the gatepost having a control member extending interiorly thereof, from an upper region of the gatepost to the lever portion of the first component of the lock assembly, the control member being displaceable lengthwise of the gatepost whereby to effect movement of the lever portion and thereby the latch portion, from the locked to the unlocked position.

17. A gate and gatepost assembly as claimed in claim 16, wherein the gatepost includes a security element for selectively securing the control member from unauthorized operation.

18. A gate and gatepost assembly as claimed in claim 17, wherein the arrangement of the element is such that the latch portion, in the absence of sufficient magnetic attraction to hold it in the locked position, returns to the unlocked position by gravity.

19. A gate and gatepost assembly as claimed in claim 16, wherein the element is mounted to extend through a slot in a wall of the body defining the cavity such that the lever portion is operable exteriorly of the cavity.

20. A gate and gatepost assembly as claimed in claim 19, wherein the gatepost includes a security element for selectively securing the control member against unauthorized operation.

21. A gate and gatepost assembly as claimed in claim 20, wherein the arrangement of the element is such that the latch portion, in the absence of sufficient magnetic attraction to hold it in the locked position, returns to the unlocked position by gravity.

22. A gate and gatepost assembly as claimed in claim 16, wherein the arrangement of the element is such that the latch portion, in the absence of sufficient magnetic attraction to hold it in the locked position, returns to the unlocked position by gravity.

23. A gate and gatepost assembly as claimed in claim 19, wherein the arrangement of the element is such that the latch portion, in the absence of sufficient magnetic attraction to hold it in the locked position, returns to the unlocked position by gravity.

* * * * *